US008061370B2

(12) United States Patent
Giachetti et al.

(10) Patent No.: US 8,061,370 B2
(45) Date of Patent: Nov. 22, 2011

(54) NAIL PROTECTION APPARATUS

(76) Inventors: Lisa Giachetti, Northport, NY (US); Joseph A. Ercole, Wellington, FL (US)

( * ) Notice: Subject to any disclaimer, the term of this patent is extended or adjusted under 35 U.S.C. 154(b) by 326 days.

(21) Appl. No.: 12/422,380

(22) Filed: Apr. 13, 2009

(65) Prior Publication Data

US 2009/0255546 A1 Oct. 15, 2009

Related U.S. Application Data

(63) Continuation-in-part of application No. 12/102,124, filed on Apr. 14, 2008.

(51) Int. Cl.
*A45D 29/00* (2006.01)
*A41D 13/08* (2006.01)
*A61F 5/00* (2006.01)

(52) U.S. Cl. ..... 132/285; 2/21; 602/22

(58) Field of Classification Search ..... 132/285, 132/319, 73, 73.5, 74.5, 320, 333, 200; 602/5, 602/6, 12, 21, 22, 30, 31, 20, 23; 2/16, 20, 2/21, 158, 159, 160, 161.7, 163; D28/56, D28/57; 623/21.11, 21.15, 54; 128/878–880; 211/85.13; 248/345.1
See application file for complete search history.

(56) References Cited

U.S. PATENT DOCUMENTS 1,160,522 A * 11/1915 Morris ..... 223/101
1,917,794 A * 7/1933 Brown ..... 602/22
2,055,357 A * 9/1936 Konecke ..... 132/285
2,179,046 A * 11/1939 Lewis ..... 2/21
2,251,551 A * 8/1941 O'Reilly ..... 2/21
2,262,977 A * 11/1941 Vasil ..... 132/285
2,287,062 A * 6/1942 Powers et al. ..... 132/285
2,297,807 A * 10/1942 Sommers ..... 2/21
2,323,854 A * 7/1943 Silverman ..... 2/21
2,428,152 A * 9/1947 Goettel ..... 132/285
2,458,709 A * 1/1949 Kayer ..... 2/21
2,485,384 A * 10/1949 Klein ..... 132/285
2,487,101 A * 11/1949 Colby et al. ..... 2/21
2,546,619 A * 3/1951 Turner ..... 2/21
2,580,893 A * 1/1952 Dee ..... 132/285
2,591,092 A * 4/1952 Okonski ..... 132/285
2,592,293 A * 4/1952 Knepper et al. ..... 132/285
3,382,878 A * 5/1968 Dinerstein ..... 132/285
4,089,066 A * 5/1978 Dethman ..... 2/21
4,605,024 A * 8/1986 Tremblay ..... 132/320
4,665,934 A * 5/1987 Jefferson ..... 132/320
4,966,174 A * 10/1990 Stanczak ..... 132/73
4,972,857 A 11/1990 Stewart et al.
4,984,592 A 1/1991 Hellein
5,031,608 A * 7/1991 Weinstein ..... 602/22
5,085,234 A * 2/1992 Silverman ..... 132/73
5,186,189 A 2/1993 Harris
5,282,276 A 2/1994 Preziose (Continued)

*Primary Examiner* — Todd Manahan
*Assistant Examiner* — Vanitha Elgart
(74) *Attorney, Agent, or Firm* — Tutunjian & Bitetto, P.C.

(57) ABSTRACT

A nail protector and method includes a cover portion dimensioned to fit over a nail of a digit to form a gap with the nail, and a bump formed on an underside of the cover portion and configured to contact skin adjacent to the nail without contact with the nail. A lateral portion is hingedly connected to the cover portion to create at least a partial enclosure for receiving the digit without passing over the nail. A biasing device is configured to secure and bias the at least one lateral portion against the digit. The biasing device extends in an opposite longitudinal direction from a distal end of the cover portion to support the cover portion and maintain the gap.

14 Claims, 16 Drawing Sheets

U.S. PATENT DOCUMENTS 5,517,692 A 5/1996 Wunderlich-Kehm
5,540,243 A 7/1996 Simonton
5,577,521 A * 11/1996 Neitlich ..... 132/285
5,699,816 A 12/1997 Banes et al.
5,725,489 A * 3/1998 Bar-Or et al. ..... 602/21
5,743,277 A * 4/1998 Moreshead ..... 132/200
5,803,094 A * 9/1998 Becker et al. ..... 132/200
5,848,597 A * 12/1998 Carpenter ..... 132/73
5,924,428 A * 7/1999 Song ..... 132/285
6,662,807 B2 12/2003 Meinschewnk
6,990,985 B1 1/2006 Allen et al.
2005/0251942 A1 * 11/2005 Gunnarsson ..... 15/227

* cited by examiner

NAIL PROTECTION APPARATUS

CROSS-REFERENCE TO RELATED APPLICATIONS

This application is a Continuation-In-Part Application of U.S. patent application Ser. No. 12/102,124, filed Apr. 14, 2008, which is incorporated by reference herein in its entirety.

BACKGROUND

1. Technical Field

This disclosure relates to an apparatus for protecting finger nails and toe nails and more particularly to an apparatus configured to protect nails from contact after a manicure/pedicure or for medical purposes.

2. Description of the Related Art

After a manicure or pedicure, it is often necessary to wait for a period of time to permit nails to dry. During this time, an individual is virtually incapacitated and unable to perform any manual tasks until their nails have dried. This is extremely inconvenient. In addition, attempting to perform any manual tasks can damage or ruin the nail's finish or polish, which jeopardizes the appearance and/or work that was needed to obtain the desired polished state of the nails. This could be costly given the expense and time needed for manicures/pedicures.

To alleviate such problems, nail protectors have been used. These are typically rings that have to be slid over the nail and the finger. While such devices, if properly applied, can protect the nail, such devices jeopardize the nail's finish, since these devices must be applied over the nail itself. Any contact with the nail will ruin the finish.

SUMMARY

A nail protector and method for use includes a cover portion dimensioned to fit over a human nail to form a gap with the human nail, and a ridge formed on an underside of the cover portion and configured to contact skin adjacent to the nail without contact with the nail. A lateral wall is connected to the cover portion to create a partial enclosure for receiving a human digit without passing over the nail. A stabilizer is coupled to the lateral wall and is spaced about from and opposite from the ridge and extends in an opposite longitudinal direction from a distal end of the cover portion.

A method for protecting nails includes providing a nail protector in accordance with the present principles and applying the nail protector on the human digit without longitudinally passing over the nail.

A nail protector and method includes a cover portion dimensioned to fit over a nail of a digit to form a gap with the nail, and a bump formed on an underside of the cover portion and configured to contact skin adjacent to the nail without contact with the nail. A lateral portion is hingedly connected to the cover portion to create at least a partial enclosure for receiving the digit without passing over the nail. A biasing device is configured to secure and bias the at least one lateral portion against the digit. The biasing device extends in an opposite longitudinal direction from a distal end of the cover portion to support the cover portion and maintain the gap.

A nail protector includes a cover portion dimensioned to fit over a nail of a digit to form a gap with the nail; a bump formed on an underside of the cover portion and configured to contact skin adjacent to the nail without contact with the nail; lateral portions hingedly connected to the cover portion to create at least a partial enclosure for inserting the digit without passing over the nail, the lateral portions extending from opposite sides of the cover portion and forming a gap therebetween, wherein the lateral portions are flexible and the gap permits lateral insertion of the digit, the lateral portions forming a stabilizer which is opposite from the bump and extends in an opposite longitudinal direction from a distal end of the cover portion, the stabilizer partially extending below the digit opposite the bump; and a biasing device configured to secure and bias the lateral portions toward the digit, the biasing device extending in an opposite longitudinal direction from the distal end of the cover portion to support the cover portion and maintain the gap.

A method for protecting nails includes providing a nail protector having a cover portion dimensioned to fit over a nail of a digit to form a gap with the nail, a bump formed on an underside of the cover portion and configured to contact skin adjacent to the nail without contact with the nail, at least one lateral portion hingedly connected to the cover portion to create at least a partial enclosure for receiving the digit without passing over the nail, and biasing the at least one lateral portion against the digit, wherein the biasing device extends in an opposite longitudinal direction from a distal end of the cover portion to support the cover portion and maintain the gap.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

The present embodiments are directed to an apparatus and method for protecting nails. In particularly useful embodiments, a nail protector is provided that covers a finger or toe nail and provides a stable cover over the nail to prevent contact with the nail. In one embodiment, the nail is protected from top and lateral contact, which is particularly helpful when the nail has been polished and has not yet dried.

In one embodiment, the nail protection apparatus includes a flexible portion, which expands to receive a finger or toe and when restored holds the nail protection apparatus in place. The apparatus includes a cover or shield portion that extends over the nail, and a median ridge or raised area that supports that cover portion. The flexible portion includes a longitudinal extension portion that extends along the finger or toe to prevent the cover portion from rotating onto the nail.

The present embodiments will illustratively be described in terms of protecting nails after a manicure or pedicure. However, the present invention is much broader and may be applicable as a nail or finger/toe protector for medical applications such as the loss of a nail due to an injury or due to an infection or other condition.

Figure 1:
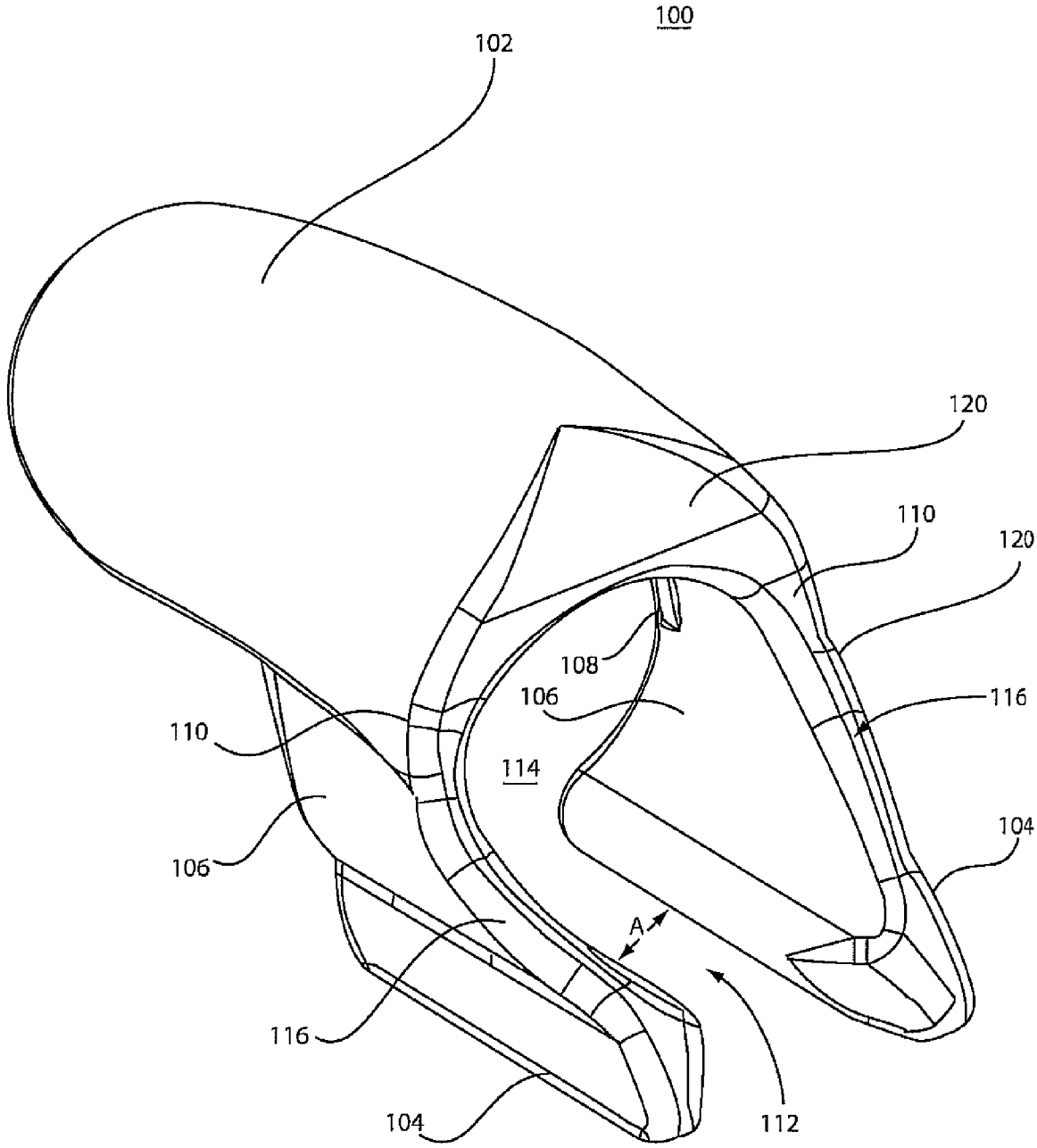
FIG. 1 is a perspective view of a nail protector in accordance with one illustrative embodiment.

Referring now to the drawings in which like numerals represent the same or similar elements and initially to FIG. 1, a nail protector 100 is shown in accordance with one illustrative embodiment. Nail protector 100 includes a cover portion 102 which is configured to cover a finger or toe nail of a user without contact to the nail itself. The cover portion 102 is permitted to cover the nail with a gap maintained between the nail and the cover portion 102. This gap is maintained during use of the nail protector 100 as will be described in greater detail below.

Nail protector 100 includes two lateral supports 116, which extend from the cover portion 102. The lateral supports 116 are connected to the cover at portions 110. Portions 110 and surrounding areas are flexible to permit a gap 112 to be increased by permitting flexure in the direction of arrow "A".

To permit flexure of portion 110 and/or of side walls 106, these portions may be formed from a flexible material. In some embodiments, the materials may include plastics, such as polyethylene, polycarbonate, rubber, etc., metals, such as steel, brass, etc., wood, or combinations thereof.

The cross-sectional dimensions of side walls 106 may be configured to provide a restoring force to return the original gap size 112. This assists in maintaining the nail protector 100 on a finger or toe of the user. Side walls 106 may be tapered (either larger or smaller) as the distance from portions 110 increases. Side walls 106 may also be of uniform thickness about the circumference of opening 114. Side walls 106 may follow any other variations in thickness as well to provide sufficient strength and restoring force to maintain gap 112 and secure the nail protector 100 on the user.

Nail protector 100 includes a ridge or extension portion 108. The ridge 108 extends under the cover portion 102 nearer to the insertion point of a finger or toe in opening 114. Ridge 108 is configured to contact the skin of the finger or toe to provide support for the cover portion 102 and prevent contact of the cover portion 102 with the nail. In addition, nail protector 100 includes longitudinal extensions 104 which are configured to extend along the finger or toe of the user and prevent rotational motion of the cover portion 102 toward the nail. Ridge 108 and longitudinal extensions 104 work together to provide support for the cover portion 102 and prevent rotational motion of the cover portion 102 toward the nail. Lateral portions 116 prevent axial rotation of the cover portion 102 on the finger or toe, and employ a restoring force to prevent the nail protector 100 from slipping forward or backward along the finger or toe once the nail protector is in place.

An insertion side of the nail protector 100 preferably includes radiused or rounded edges 120 to provide comfort for the wearer and ease application of the protector device. It should be understood that the present principles may be practiced with many different designs and configurations. The presently described embodiments are illustrative only and should not be construed as limiting.

Figure 2:
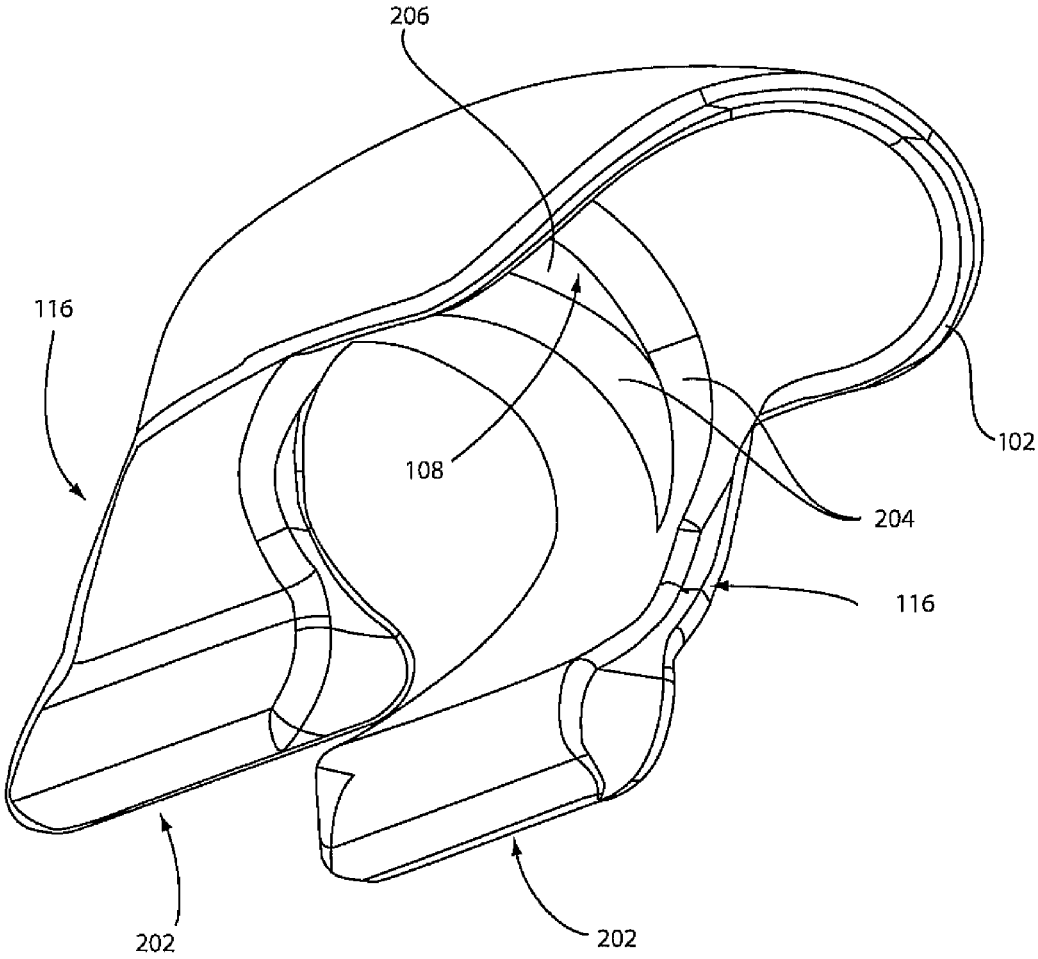
FIG. 2 is a perspective view of the nail protector of FIG. 1 showing the underside and depicting a ridge in accordance with one embodiment.

Referring to FIG. 2, another view of the nail protector 100 of FIG. 1 is illustratively depicted to show an underside of the nail protector 100. The ridge 108 is shown extending over a sector of the perimeter of opening 114 below the cover portion 102. Ridge 108 includes generous transitions 204 to permit the nail protector 100 to be easily applied on a finger or toe, and for comfort. A top portion 206 of ridge 108 makes contact with the skin of a finger or toe. The internal upper portion of ridge 108 features a build up of material allowing for adequate nail clearance.

Ends 202 of lateral portion 116 are preferably rounded and provide sufficient material to extend below the finger or toe once positioned thereon.

Figure 3:
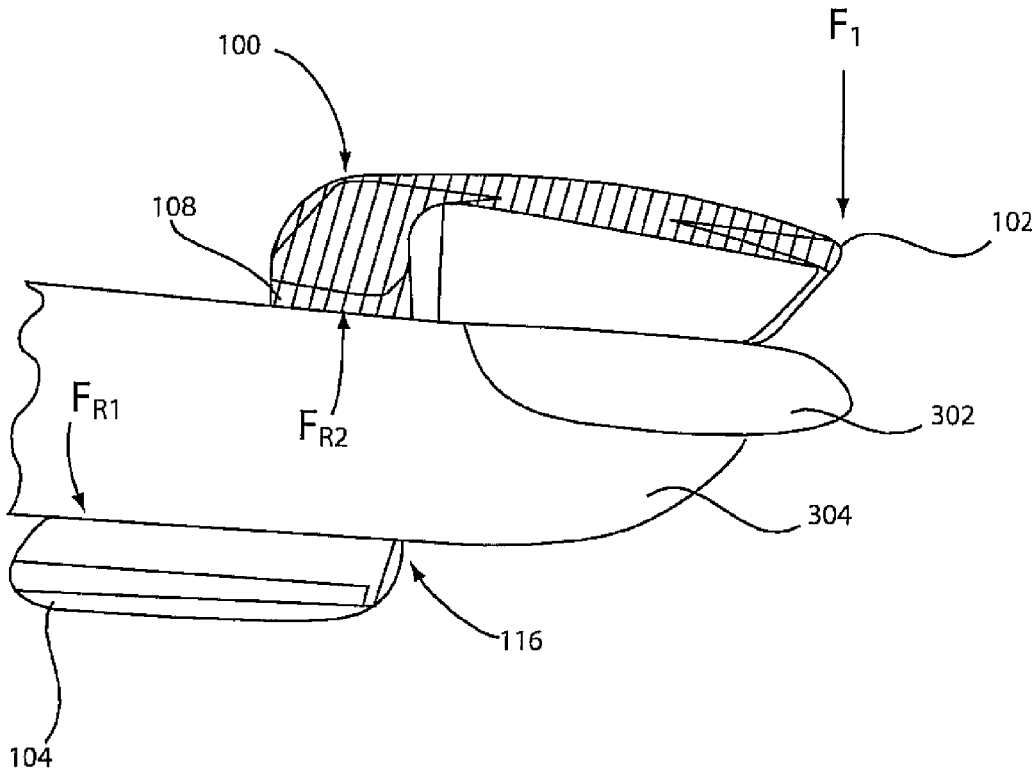
FIG. 3 is a side view of a finger with a nail protector where the nail protector is shown in cross-section with reaction forces in accordance with one embodiment.

Referring to FIG. 3, a further explanation of the functionality of the nail protector 100 will now be illustratively described using a cross-sectional view of nail protector 100 depicted on a finger 304. If for example, a force $F_1$ is applied to the cover portion 102, reaction forces $F_{R1}$ and $F_{R2}$ will maintain the cover portion 102 in its current position and prevent contact with a nail 302 of finger 304. Reaction force $F_{R1}$ results from the longitudinal extensions 104 extending along finger 304 on an opposing side of the pivot point created by ridge 108. Reaction force $F_{R2}$ is provided by contact with ridge 108 with finger 304.

As described previously, lateral portions 116 extend below finger 304 and provide support to generate reaction forces $F_{R1}$. Nail protector 100 is therefore stable on the finger 304, and prevents contact of the nail protector or other objects with nail 302.

The nail protector 100 may include other features to provide similar effects. These features are illustratively described below, but should not be construed as limiting.

Figure 4:
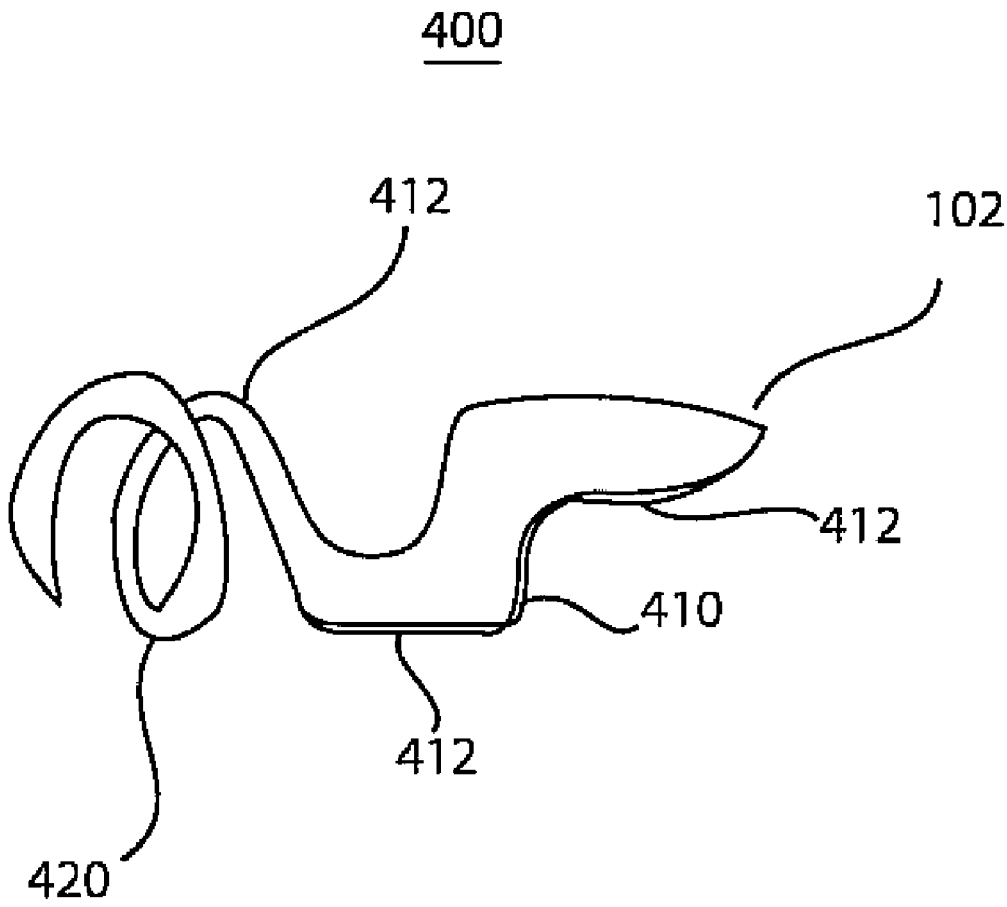
FIG. 4 is a side view of a nail protector where a stabilization portion is provided by a coil in accordance with one embodiment.

Referring to FIG. 4, a nail protector 400 includes a cover portion 102 and one or two side portions 410 that can extend into a coil 420. The cover portion includes a ridge 108 as before and employs the coil 420 to generate the reaction force $F_{R1}$ (FIG. 3). In this way, the nail protector 400 is placed on a side of the finger or toe and the coil 420 is wrapped around the user's finger to secure the nail protector 400. The coil 420 is formed from a flexible material and is connected to or formed with the rest of the nail protector 400.

As before, the open ended ring permits the nail protector 400 (or 100) to clamp onto the finger or toe to avoid passing over a painted nail. Edges 412 of nail protector 400 are preferably bull-nosed and flared to serve as a necessary guide for placement on the finger.

Nail protectors 100 and 400 provide a rear stabilizer using longitudinal extensions 104 or using coil 420 (FIG. 1) for preventing the nail cover portion from making contact with the nail.

Figure 5:
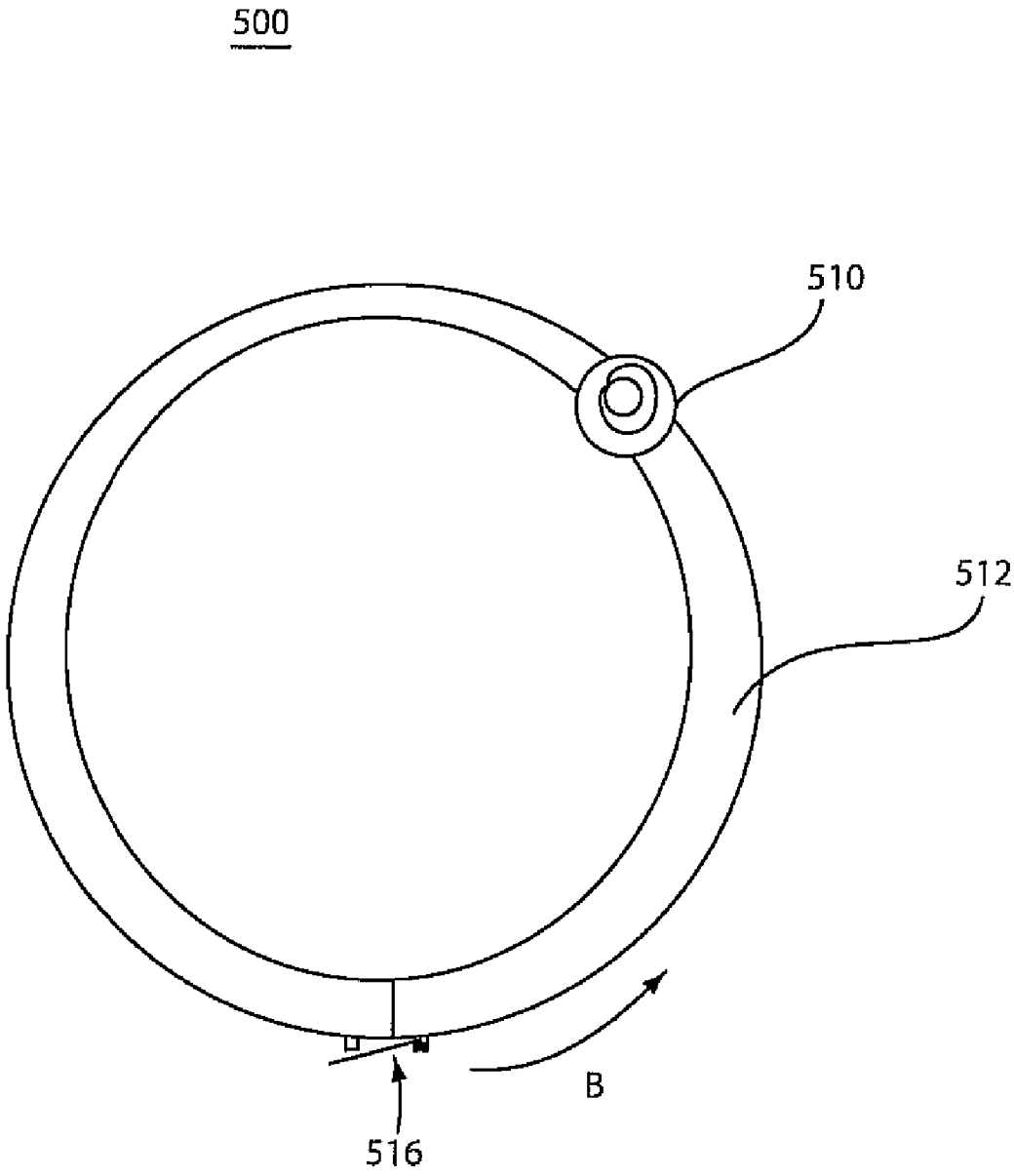
FIG. 5 is a rear view of a nail protector where a biased hinge is employed to maintain a lateral wall in a closed position and permit the nail protector to be applied to a human digit in an open position in accordance with one embodiment.

Referring to FIG. 5, a nail protector 500 is conceptually depicted showing a biased hinge 510 to permit opening and closing of a lateral side 512 of nail protector 500. Hinge 510 may include a spring 514 as a biasing means to bias the lateral side 512 in a closed position (shown). When the nail protector is to be placed on a finger the lateral side is opened in the direction of arrow "B", the finger is then placed inside the nail protector 500 and the lateral side 512 is closed. An optical latch 516 may be employed to lock the lateral side 512 in place to secure the nail protector 500 to the finger of the wearer. FIG. 5 has omitted features for simplicity of explanation, e.g., the cover portion, the ridge and rear stabilization portions are not shown.

Figure 6:
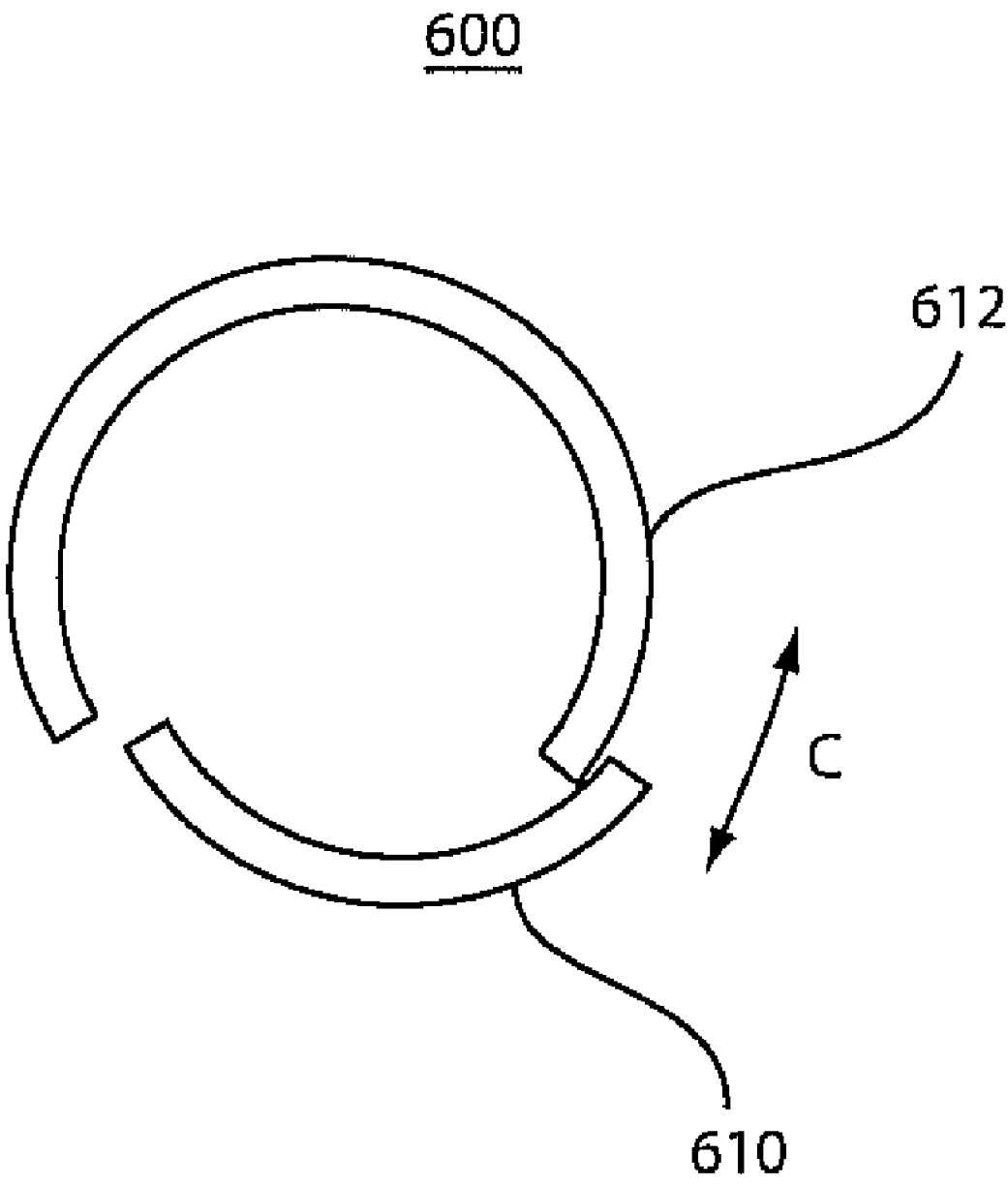
FIG. 6 is a rear view of a nail protector where rotatable clasp is employed to maintain a wall in a closed position and permit the nail protector to be applied to a human digit in an open position in accordance with one embodiment.

Referring to FIG. 6, a nail protector 600 may include a clasp 610 that rotates about a finger in the direction of arrow "C". The clasp 610 is opened to permit a finger to be placed inside the nail protector 600 and then the clasp 610 is closed to secure the nail protector 600 to the finger of the wearer. The clasp 610 may be stowed on the side of a base portion 612 in the open position. FIG. 6 has omitted features, e.g., the cover portion, the ridge and rear stabilization portions, for simplicity. The clasp 610 may employ any known mechanical slides, concentric walls or other known elements for providing the mechanical features for sliding the clasp 610 into or out of a closed position.

Nail protectors 100, 400, 500 and 600, in accordance with the present principles, may include additional features and modifications. In one embodiment, the cover portion 102 is formed from a clear resilient plastic material (e.g., polycarbonate) so that the polished nail is visible. The construction material may include polypropylene, polyethylene, polycarbonate, etc.

The nail protectors 100, 400, 500 and 600 may be fabricated to be disposable or reusable. Reusable embodiments may include the use of washable or sterilizable materials. In either case, the nail protector is preferably ergonomic, light weight and recyclable. In addition, construction materials for the nail protector may be colored, textured or otherwise decorated to suit personal preferences. Nail protectors 100, 400, 500 and 600 may include a plurality of sizes to permit proper fitting for a plurality of different sized fingers and toes.

Figure 7:
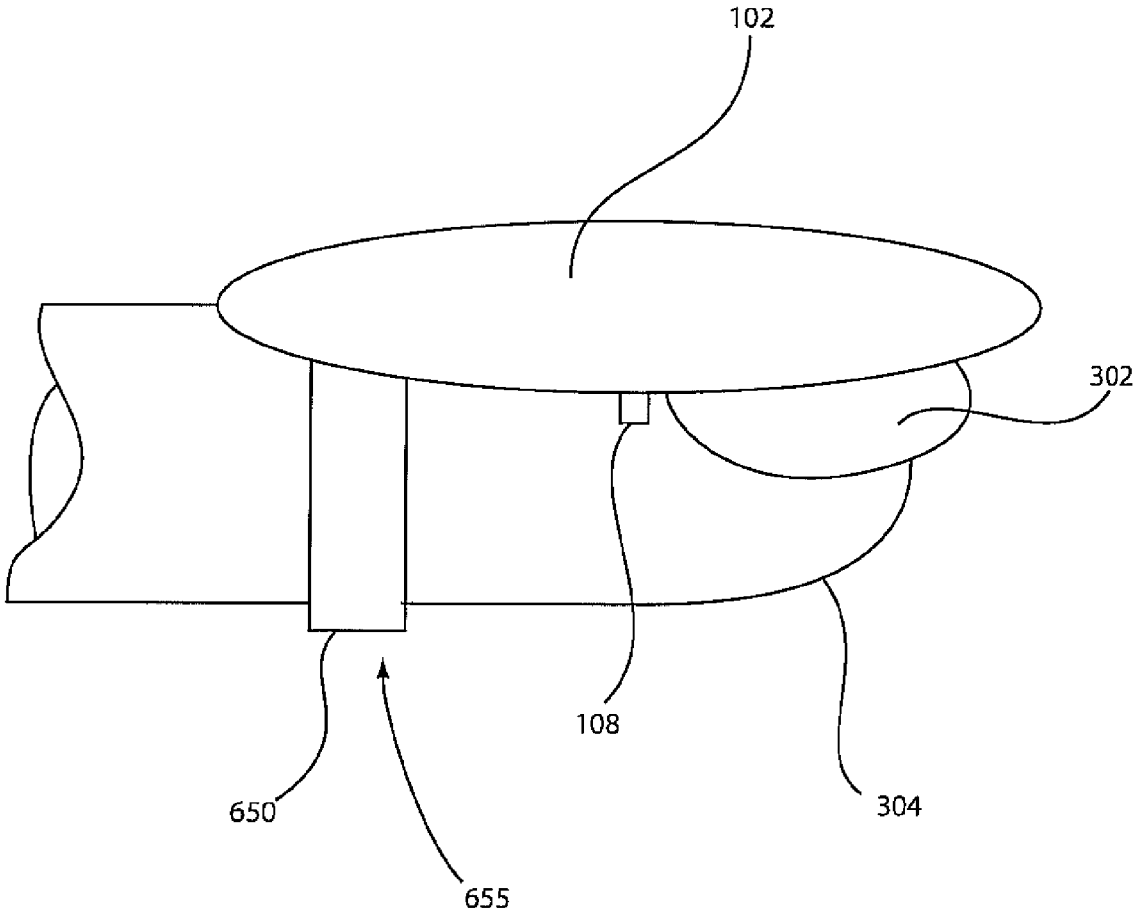
FIG. 7 is a side view of a nail protector where an insert is connected to a cover portion, the insert providing the functions of the stabilization portion and the lateral walls in accordance with one embodiment.

Referring to FIG. 7, an insert 650 may be employed which detachably snaps into the cover portion 102 to provide the functions the stabilizer and of the lateral walls to hold the nail protector fast on the finger or toe. Inserts 650 may provide the proper fit one the finger and lock into the cover portion 102. The insert 650 as with the other nail protectors are made in accordance with standard finger/toe size dimensions. This is particularly useful for reusable nail protectors. The inserts 650 may be unshaped and fit over the finger without going over the nail. Then, the cover portion 102 may be attached over the insert 650. The insert 650 may have a locking feature, such as a detent. snap, clasp, etc. to provide attachment to the nail protector 655 to complete a ring formed using both the insert 650 and the nail protector 655. The inserts may be formed from plastics, metals, foams, etc. and may be utilized to accommodate various finger sizing.

Nail protectors in accordance with the present invention may be integrally formed as a single piece or may include a removable/detachable cover portion 102 to permit for interchangeable styles of the cover portion 102.

Figure 8:
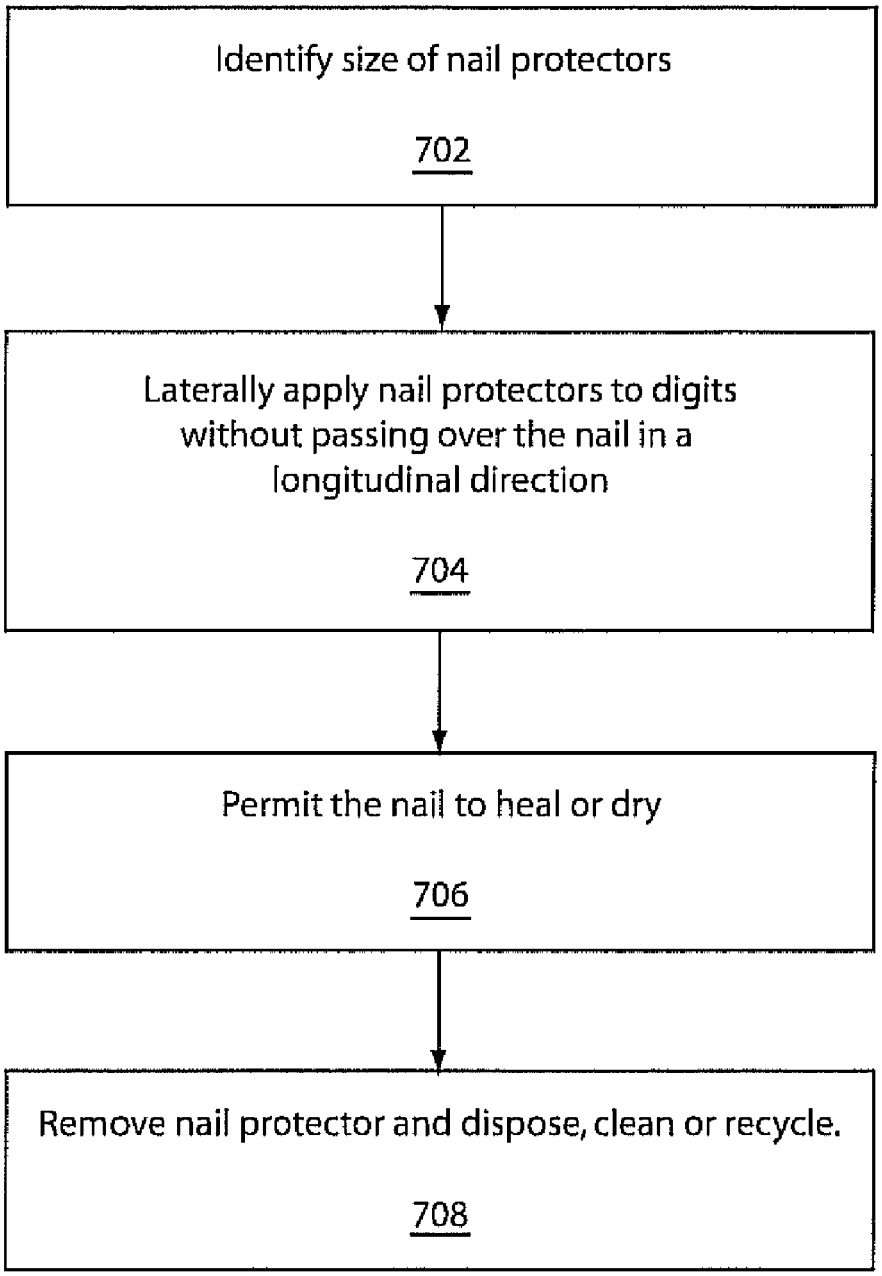
FIG. 8 is a flow diagram showing a method for employing a nail protector in accordance with one embodiment.

Referring to FIG. 8, a flow diagram shows a method for employing a nail protector in accordance with the present invention. After a manicure/pedicure or a need for protecting nails arises, proper sized nail protectors (or inserts) are identified in block 702. In block 704, the nail protectors are applied to the fingers or toe from a lateral direction over a finger or toe without passing over the nail in a longitudinal direction. This includes spreading flexible parts, opening a hinge or clasp or otherwise attaching the nail protector to a finger/toe (e.g., using inserts and protector to connect and form a ring). In block 706, the finger/toe is permitted to heal or the nail permitted to dry. In block 708, the nail protector is removed and disposed of, cleaned/sterilized or recycled.

Figure 9:
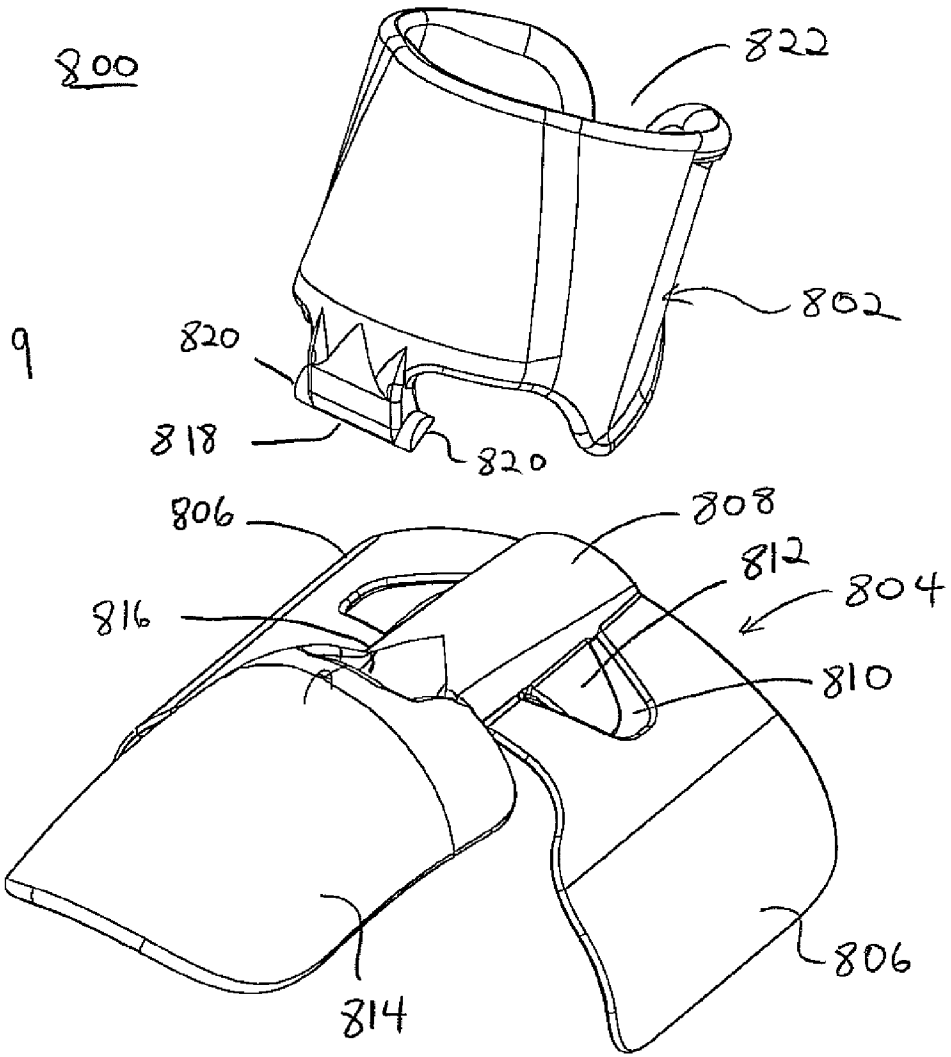
FIG. 9 is a perspective view of a nail protector having lateral portions hingedly connected to a spine and a biasing device for securing the lateral portions to a finger or toe in accordance with an illustrative embodiment.

Referring to FIG. 9, a nail protector system 800 is shown in accordance with another embodiment. System 800 includes a cover portion 814 coupled to a spine 808. Cover portion 814 covers a finger nail or toe nail and permits protection thereof after a manicure/pedicure, polish, surgery or any other event that calls for the protection of the digit or the nail on a digit. Cover portion 814 includes a bump (e.g., rib, ridge or boss 206, FIG. 2) at its underside (not shown) as described above. Spine 808 hingedly connects to two lateral portions 806. This may be accomplished by using a smaller material thickness at a portion of the lateral portions 806 forming the hinge. Other structures may be employed to form hinges of hinge-like structures as well. The lateral portions 806 are preferably biased outwardly for ease of use when inserting a digit laterally within the enclosure formed by the lateral portions 806.

The lateral portions 806 rotate inwardly towards each other to secure a digit therebetween. Although FIG. 9 shows two lateral portions 806, it should be understood that a single lateral portions may be employed which either wraps around the finger or is present on only one side of the finger, or is present on one side and the bottom of the finger (opposite the nail protection portion 814).

In one embodiment, spine 808 includes fins 812 which are disposed within openings 810 of the lateral portions 806. The fins 812 provide protection to the hinge portion of the lateral portions 806 and further provide a guide or relief for installing a biasing device such as a collar 802. When the collar 802 is installed over spine 808 and lateral portions 806, a connector 818 fits into a recess 816 to form a hinged connection using protrusions B20. The collar 802 includes an opening 822 extending longitudinally along the collar 802.

After an engagement mechanism 804 is placed on a digit, the connector 818 is previously or currently installed in the recess 816. The collar 802 is rotated downwardly and the spine 808 and eventually the lateral portions 806 are received internally in the collar 802 through the opening 822. The rotation of the collar 802 draws the lateral portions 806 inward to grasp the digit snugly to prevent the system 800 from falling off and to provide sufficient resistance against impact or use of the digit for manual activities.

Figure 10:
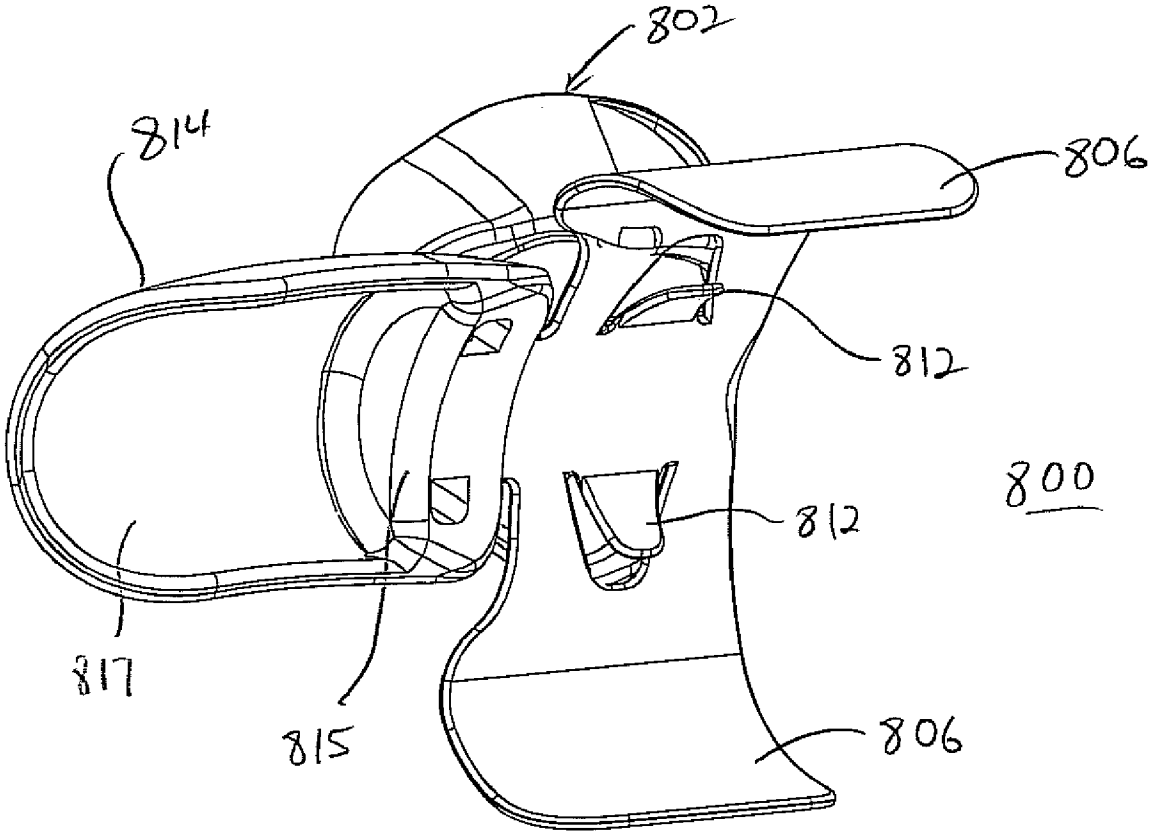
FIG. 10 is a perspective view of the nail protector showing an underside of the cover portion in accordance with an illustrative embodiment.

Referring to FIG. 10, an underside of the protector 800 is illustratively shown. A bump 815 extends from an undersurface of nail protection portion 814. This bump 815 (ridge, rib, etc.) functions in the same way as boss 206 shown in FIG. 2.

Figure 11:
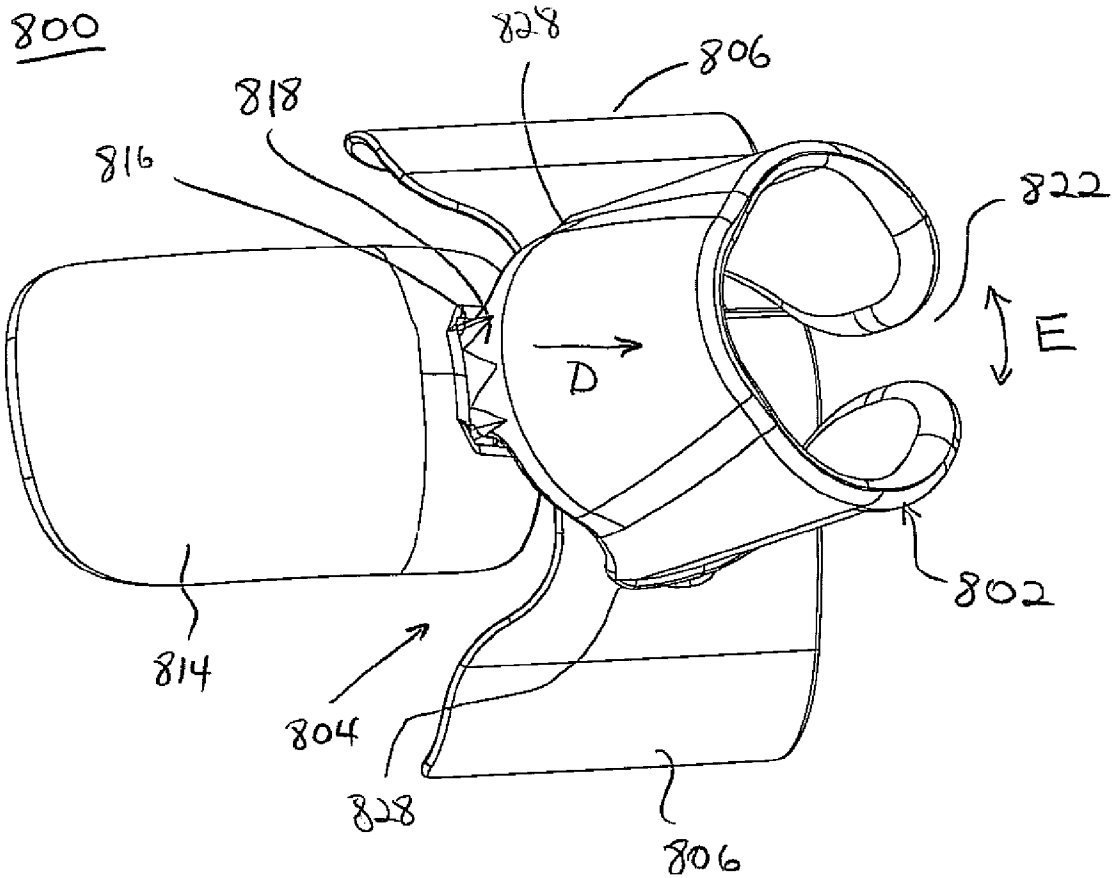
FIG. 11 is a perspective view of the nail protector of FIG. 9 having the biasing device hingedly connected to a cover portion in accordance with an illustrative embodiment.

Referring to FIG. 11, the connector 818 of collar 802 is shown connected with engagement portion 804 at recess 816. The connection between collar 802 and engagement portion

804 forms a hinge to enable the collar 802 to move in the direction of arrow "D" and rotate using protrusions 820 (FIG. 9) as an axis of rotation. As collar 802 moves in the direction of arrow "D", contoured surfaces 828 pass over lateral portions 806 causing the gap 822 to open in the direction of arrow "E". This in turn provides a spring force to be applied to the lateral portions 806 to first close them onto a digit and then secure them on the digit.

Figure 12:
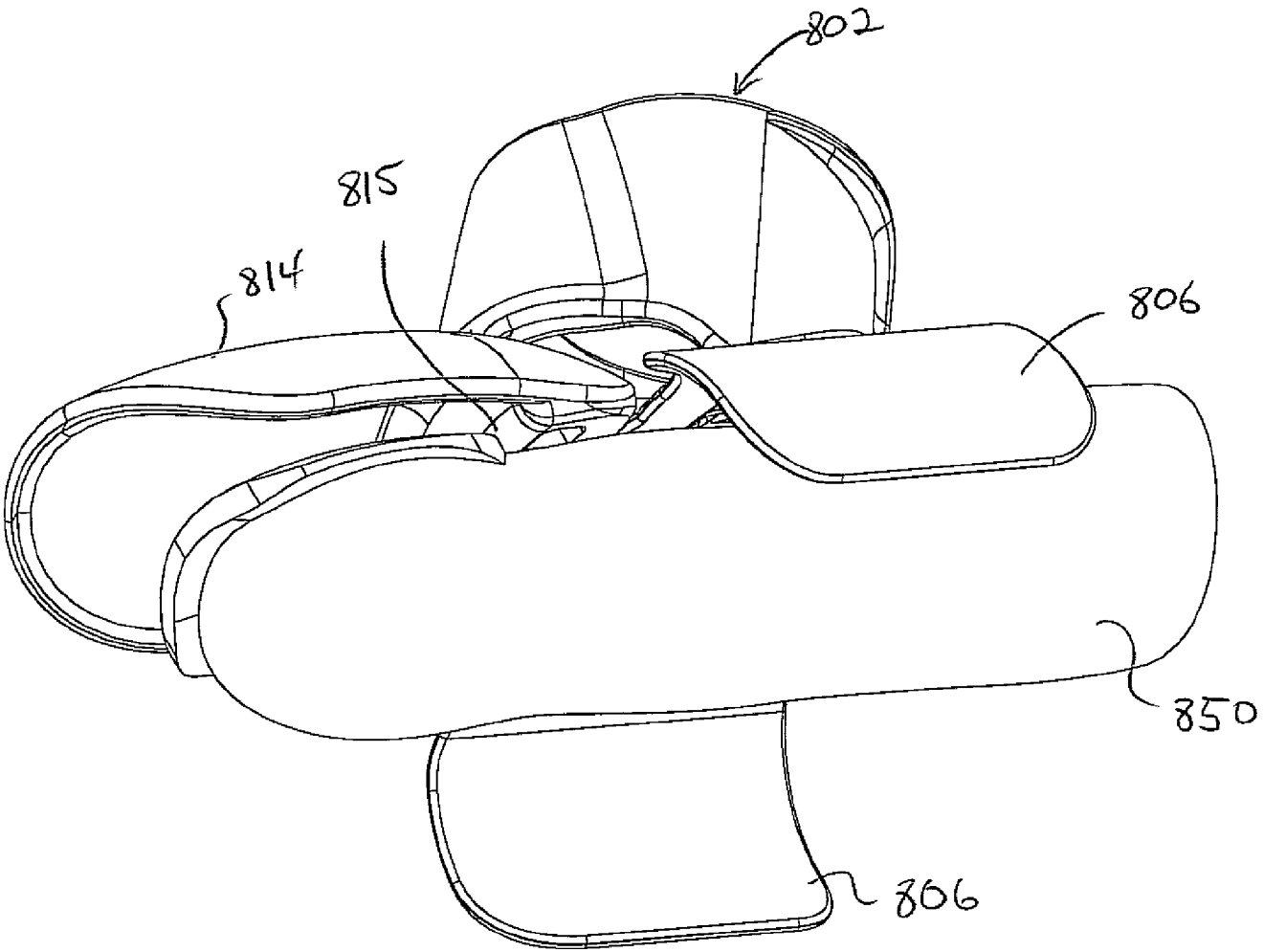
FIG. 12 is a perspective view of the nail protector of FIG. 9 showing lateral insertion of a finger therein in accordance with an illustrative embodiment.
Figure 13:
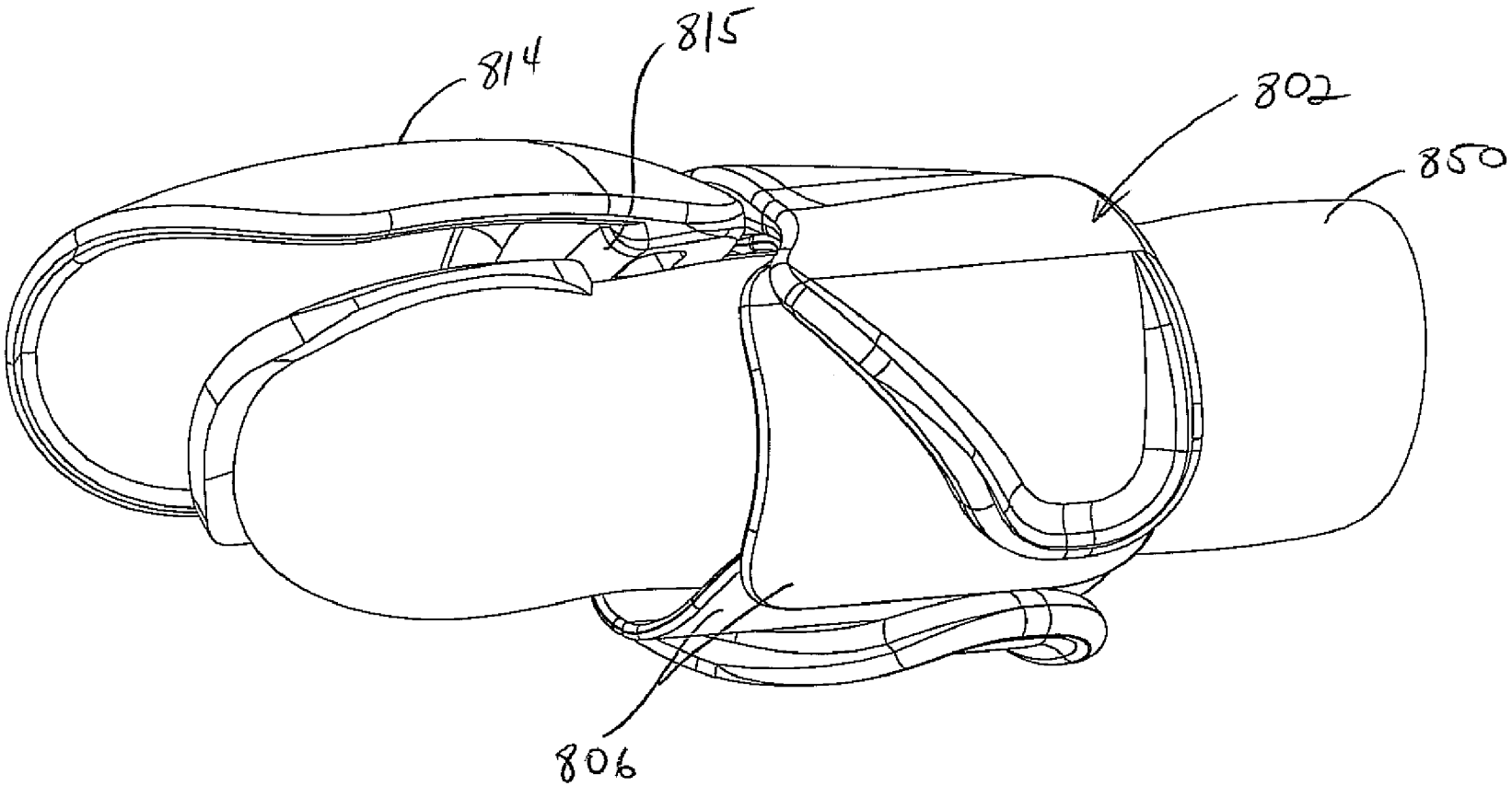
FIG. 13 is a perspective view of the nail protector of FIG. 12 after the nail protector is closed to capture the finger in accordance with an illustrative embodiment.

Referring to FIG. 12, a digit, such as a finger 850, is placed within the protector 800. The lateral portions 806 are open to receive finger 850 therein. The collar 802 is rotated downward over the lateral portion 806 and the finger 850 to secure the protector 800 to the finger 850 as shown in FIG. 13. The lateral portions 806 can overlap each other to provide for flexibility in properly sizing a ring formed by the collar 802 and lateral portions 806 over the finger 850. As depicted in FIG. 13 the protector 800 is securely fastened on the finger 850.

Figure 14:
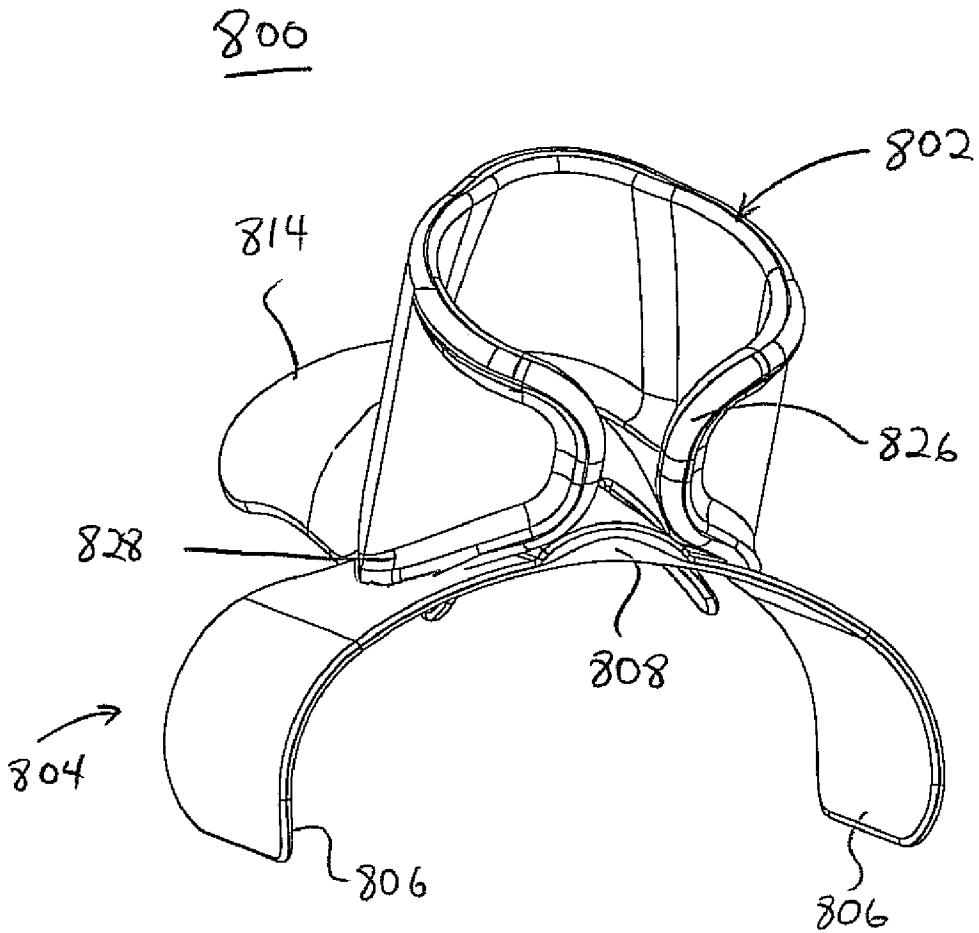
FIG. 14 is a perspective view of the nail protector of FIG. 9 shown from a rear view in accordance with an illustrative embodiment.

Referring to FIG. 14, the collar 802 includes features that assist in permitting the collar 802 to be applied and secured over the lateral portions 806. For example, spine 808 includes a cylindrical or part-cylindrical shaped cross-section to assist in separating the gap 822 in the collar 802. Edges 826 of the collar are preferably generously radiused or chamfered to permit ease of movement between the collar and the lateral portions 806.

Figure 15:
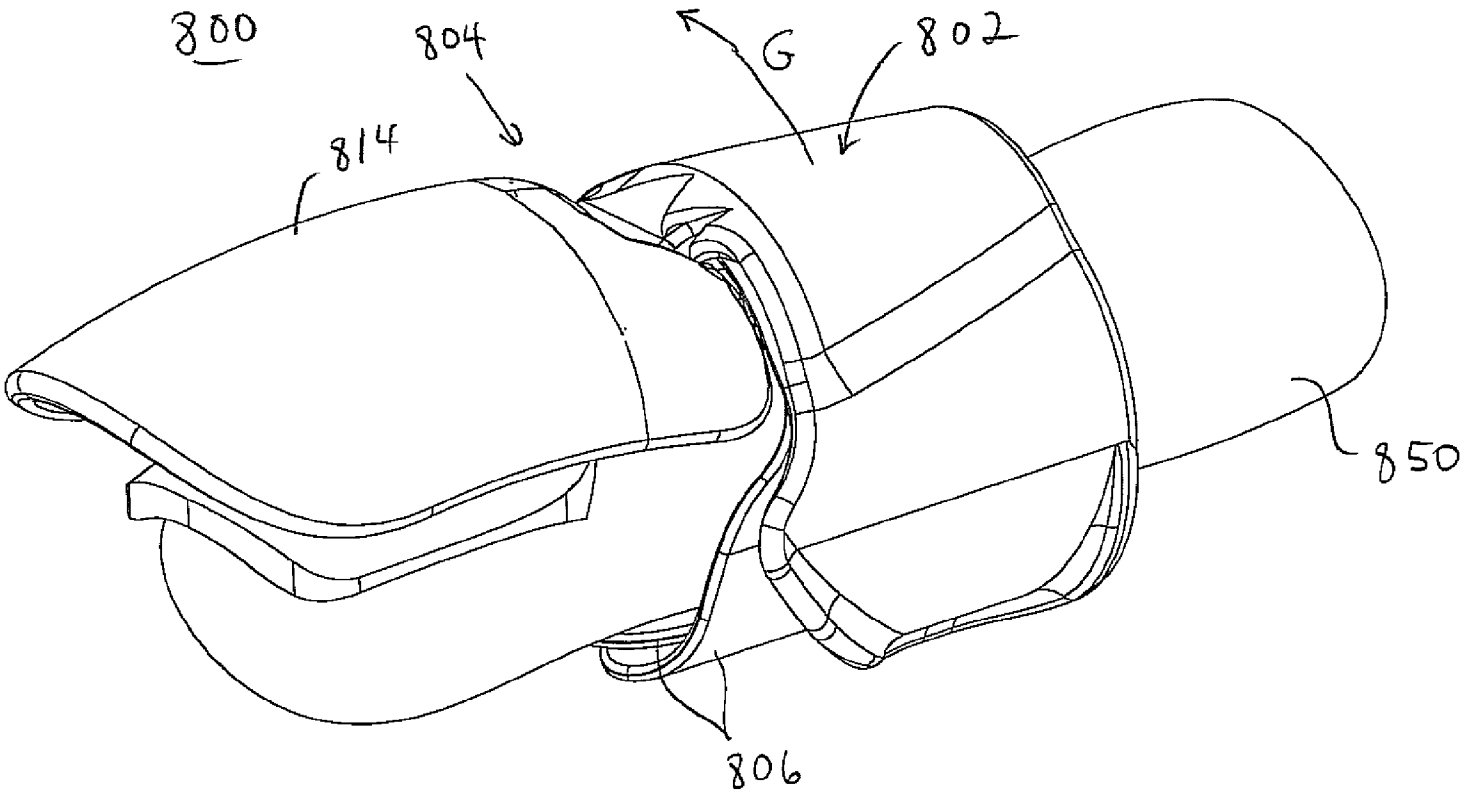
FIG. 15 is a perspective view of the nail protector after the lateral portions have been secured by a biasing device to a finger or toe in accordance with an illustrative embodiment.

Referring to FIG. 15, the system 800 is shown with the collar 802 fully secured over the lateral portion 806 to secure the system on a digit (e.g., a finger or toe) 850. The spring force of the collar 802 secures the lateral portions 806 over the finger or toe 850 and provides a sufficient pre-force to maintain the position of the system 800 on the finger 850.

Advantageously, since the collar 802 and the lateral portions 806 are flexible, the system can be employed on any sized finger/toe. In this way, the same parts for system 800 may be used for any sized digit on the same person or on multiple persons. This reduces or eliminates the need for customized sizing for different people or different fingers/toes. One size fits all.

To release the digit, the collar 802 is simply pivoted back up in a reverse direction in the direction of arrow "G". This permits the lateral portions 806 to be free to rotate outward and release the digit 850. The collar 802 and the engagement portion 804 may be formed from any suitable material. Suitable materials may include metals, plastics, rubber, wood, etc. or combinations thereof. The collar 802 should be flexible yet elastic to provide a spring force to hold down the lateral portions 806. The engagement portion 804 should include a material that is resilient enough to provide impact protection but flexible enough to permit elastic forces to develop.

It should be understood that the system 800 provides at least the same advantages as the other embodiments described above. For example, the structure provided by the system 800 handles the forces in the same manner as depicted and described with reference to FIG. 3. At least one lateral portion may include a biased hinge such that a portion of the at least one lateral portion can be opened to receive the digit.

Figure 16:
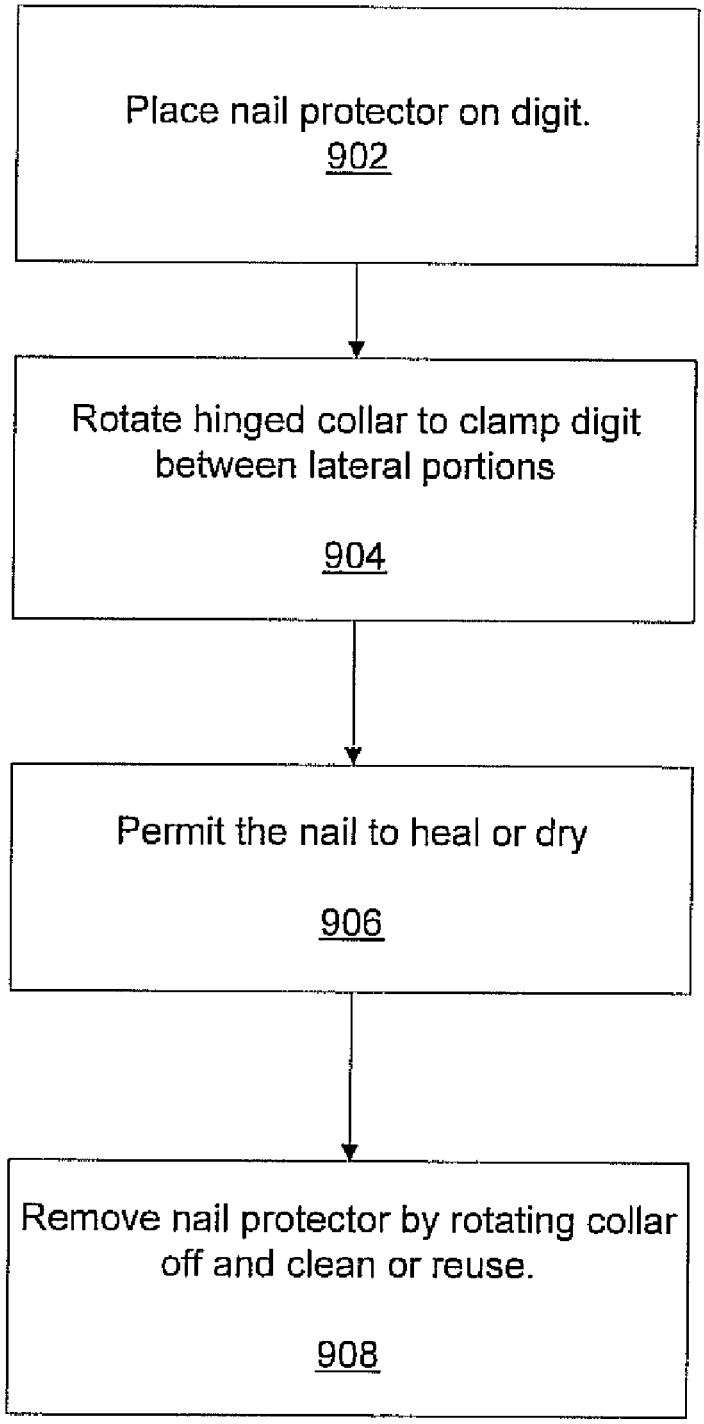
FIG. 16 is a flow diagram showing a method for employing a nail protector in accordance with one embodiment.

Referring to FIG. 16, a flow diagram shows a method for employing a nail protector in accordance with the present invention. After a manicure/pedicure or a need for protecting nails arises, a nail protector is placed on a finger or toe in block 902. In block 904, a hingedly connected or separate collar is rotated downward or otherwise applied on lateral portions to close the lateral portions on the fingers or toes to attach and secure the nail protector to a finger/toe. The collar provides a spring load to clamp the lateral portions and hold the nail protector on the finger/toe. In block 906, the finger/toe is permitted to heal or the nail permitted to dry. In block 908, the nail protector is removed be rotating the collar upward. The nail protector may be reused, cleaned or disposed of.

Having described preferred embodiments of a nail protector and method (which are intended to be illustrative and not limiting), it is noted that modifications and variations can be made by persons skilled in the art in light of the above teachings. It is therefore to be understood that changes may be made in the particular embodiments disclosed which are within the scope and spirit of the invention as outlined by the appended claims. Having thus described aspects of the invention, with the details and particularity required by the patent laws, what is claimed and desired protected by Letters Patent is set forth in the appended claims.

What is claimed is:

1. A nail protector, comprising:

a cover portion dimensioned to fit over a nail of a digit to form a gap with the nail;

a bump formed on an underside of the cover portion and configured to contact skin adjacent to the nail without contact with the nail;

at least one lateral portion hingedly connected to the cover portion to create at least a partial enclosure for receiving the digit without passing over the nail; and a biasing device having an opening configured to receive and bias the at least one lateral portion hingedly connected to the cover portion against the digit, the biasing device extending in an opposite longitudinal direction from a distal end of the cover portion to support the cover portion and maintain the gap.

2. The nail protector as recited in claim 1, wherein the at least one lateral portion includes two lateral portions hingedly connected to a spine of the cover portion.

3. The nail protector as recited in claim 2, wherein the biasing device includes surfaces to bring the two lateral portions together to clamp on the digit.

4. The nail protector as recited in claim 1, wherein the at least one lateral portion includes a biased hinge such that a portion of the at least one lateral portion can be opened to receive the digit.

5. The nail protector as recited in claim 1, wherein the biasing device includes a connector portion receivable in the cover portion to provide a hinged connection therebetween.

6. The nail protector as recited in claim 5, wherein the biasing device biases the at least one lateral portion to hold the nail protector on the digit when the biasing device is in a first rotated position and the digit is released when the biasing device is in a second rotated position.

7. A nail protector, comprising:

a cover portion dimensioned to fit over a nail of a digit to form a gap with the nail;

a bump formed on an underside of the cover portion and configured to contact skin adjacent to the nail without contact with the nail;

lateral portions hingedly connected to the cover portion to create at least a partial enclosure for inserting the digit without passing over the nail, the lateral portions extending from opposite sides of the cover portion and forming a gap therebetween, wherein the lateral portions are flexible and the gap permits lateral insertion of the digit, the lateral portions forming a stabilizer which is opposite from the bump and extends in an opposite longitudinal direction from a distal end of the cover portion, the stabilizer partially extending below the digit opposite the bump; and a biasing device configured to secure and bias the lateral portions toward the digit, the biasing device extending in an opposite longitudinal direction from the distal end of the cover portion to support the cover portion and maintain the gap, wherein the biasing device includes a collar having an opening therein to receive the lateral portions and the digit such that the biasing device imparts a securing force to the lateral portions to secure the nail protector on the digit.

8. The nail protector as recited in claim 7, wherein the lateral portions are hingedly connected to a spine of the cover portion.

9. The nail protector as recited in claim 8, wherein the biasing device includes surfaces to bring the two lateral portions together to clamp on the digit.

10. The nail protector as recited in claim 7, wherein the biasing device includes a connector portion receivable in the cover portion to provide a hinged connection therebetween.

11. The nail protector as recited in claim 10, wherein the biasing device biases the lateral portions to hold the nail protector on the digit when the biasing device is in a first rotated position and the digit is released when the biasing device is in a second rotated position.

12. A method for protecting nails comprising:

providing a nail protector having a cover portion dimensioned to fit over a nail of a digit to form a gap with the nail, a bump formed on an underside of the cover portion and configured to contact skin adjacent to the nail without contact with the nail, at least one lateral portion hingedly connected to the cover portion to create at least a partial enclosure for receiving the digit without passing over the nail; and biasing the at least one lateral portion against the digit, wherein the biasing device extends in an opposite longitudinal direction from a distal end of the cover portion to support the cover portion and maintain the gap, wherein the at least one lateral portion includes two lateral portions with an opening therebetween to permit a lateral insertion of the digit, and biasing includes flexing a gap in a collar and installing the collar over the two lateral portions to close the opening therebetween to clamp the lateral portions on the digit.

13. The method as recited in claim 12, wherein the collar includes a connector portion receivable in the cover portion to provide a hinged connection therebetween, wherein the collar biases the lateral portions to hold the nail protector on the digit when the collar is in a first rotated position and the digit is released when the collar is in a second rotated position.

14. The method as recited in claim 12, wherein the lateral portions are configured to receive plurality of different sized digits.

* * * * *